US005181073A

United States Patent [19]

Araki

[11] Patent Number: 5,181,073

[45] Date of Patent: Jan. 19, 1993

[54] COPYING APPARATUS

[75] Inventor: Kazuhiro Araki, Okazaki, Japan

[73] Assignee: Minolta Camera Kabushiki Kaisha, Osaka, Japan

[21] Appl. No.: 724,715

[22] Filed: Jul. 2, 1991

[30] Foreign Application Priority Data

Jul. 3, 1990 [JP] Japan ..... 2-176935

[51] Int. Cl.[5] ..... G03G 15/04

[52] U.S. Cl. ..... 355/243; 355/203; 355/208; 355/209; 355/308

[58] Field of Search ..... 355/203, 204, 208, 209, 355/243, 311, 75, 308, 309

[56] References Cited

U.S. PATENT DOCUMENTS

| | | | |
|---|---|---|---|
| 4,456,372 | 6/1984 | Yamauchi | 355/75 |
| 4,511,246 | 4/1985 | Nishiyama | 355/75 |
| 4,512,655 | 4/1985 | Ishida et al. | 355/55 |
| 4,647,189 | 3/1987 | Fujiwara et al. | 355/243 X |
| 4,692,019 | 9/1987 | Morimoto et al. | 355/75 X |
| 4,764,788 | 8/1988 | Watashi et al. | 355/75 X |
| 4,851,883 | 7/1989 | Ito | 355/243 X |
| 4,963,934 | 10/1990 | Nezu | 355/243 X |
| 5,016,049 | 5/1991 | Onishi et al. | 355/203 |
| 5,065,198 | 11/1991 | Yamishita et al. | 355/243 X |

FOREIGN PATENT DOCUMENTS

| | | | |
|---|---|---|---|
| 0052842 | 3/1985 | Japan | 355/311 |
| 0102655 | 6/1985 | Japan | 355/243 |
| 60-263965 | 12/1985 | Japan . | |
| 0262733 | 11/1986 | Japan | 355/311 |
| 0006243 | 1/1987 | Japan | 355/311 |
| 0065028 | 3/1987 | Japan | 355/311 |
| 0070865 | 3/1988 | Japan | 355/311 |
| 0177561 | 7/1989 | Japan | 355/243 |

*Primary Examiner*—A. T. Grimley
*Assistant Examiner*—Matthew S. Smith
*Attorney, Agent, or Firm*—Burns, Doane, Swecker & Mathis

[57] ABSTRACT

An indication mechanism is controlled in a timing after the size of an original to be used for a copying operation is detected prior to the copying operation so as to indicate the size of a copy paper and a copying magnification to be automatically selected which are based on an action mode which has been set and the detected size information, and a mode changing action which corresponds to the indication is controlled to be performed prior to the copying operation basing on a copying action starting signal.

13 Claims, 13 Drawing Sheets

COPYING APPARATUS

BACKGROUND OF THE INVENTION

1. Technical Field of the Invention

The present invention relates to a copying apparatus, and more particularly, to a copying apparatus which is arranged to detect the size of an original to be copied in a predetermined timing prior to a copying operation and perform copying the original in a selection mode which has been based on the detected size information wherein an automatic paper selection mode for automatically selecting a paper feed outlet which accommodates a sheet of paper which corresponds to the size of an original and an automatic magnification selection mode for automatically selecting a copying magnification by the sizes of the paper and original are provided.

2. Description of Related Art

The applicant of the present invention has previously proposed a copying machine of this kind. In the copying machine, it is arranged to automatically detect the size of an original placed on a platen glass accompanying by an original setting action of covering the original with an original cover. When a copying operation is performed in a selection mode already set based on a detected size information, a size of paper to be selected and the information on a copying magnification which are decided by the mode and detected size of original are indicated with further action of changing a mode to the indicated mode for the following copying operation.

Besides, there is also a copying machine known which is arranged to detect the size of an original accompanying by the actions of setting and covering the original, and indicate a copying magnification and the size of a paper to be selected which are decided by a selection mode and the detected size information with further action of changing a mode to the indicated mode.

In the copying machine already proposed by the applicant of the present invention, however, a magnification and size of paper to be selected which are decided by a selection mode and a detected size information are not indicated until a copying operation is started. The operator of the machine is, therefore, obliged to operate the machine without having such an indication and not able to make sure the size of paper and copying magnification selected until a copying operation is started. Accordingly, it causes anxiety to the operator if the copying operation is performed with an anticipated mode.

In the above-mentioned copying machine known, it is arranged to indicate the size of a paper and a copying magnification before a copying operation is performed so that the operator is able to operate the machine without having any anxiety. However, when an original cover is closed, a copying magnification changing action is executed and a projection lens is moved. Accordingly, a size of a paper and a copying magnification are changed corresponding to a mode indicated before the original cover is closed for copying operation, a mode changing action is conducted again with another movement of the projection lens causing the lens to move excessively. The starting time of copying operation is delayed with such an action. Moreover, when an original is set and the projection lens is started to move, copying operation can not be started during the movement of the lens. The operator can not, therefore, leave from the machine immediately after an original is set which is defective in working efficiency.

SUMMARY OF THE INVENTION

A primary object of the present invention is to provide a copying apparatus which is capable of solving the above-mentioned conventional problems.

Another object of the present invention is to provide a copying apparatus which is capable of solving the above-mentioned conventional problems by skillful improvement wherein the timing for indicating the size of a paper and a copying magnification to be automatically selected based on a detected size of an original and the copying action mode already set, and the timing for changing a mode to an indicated copying action mode are set relative to the operation of original setting action and the following copy starting action.

These and other objects and features of the present invention will become more apparent from the following description taken in conjunction with the accompanying drawings which illustrate specific embodiments of the invention.

DESCRIPTION OF THE PREFERRED EMBODIMENT

An embodiment of the present invention will now be described hereinafter referring to the accompanying drawings.

Figure 1:
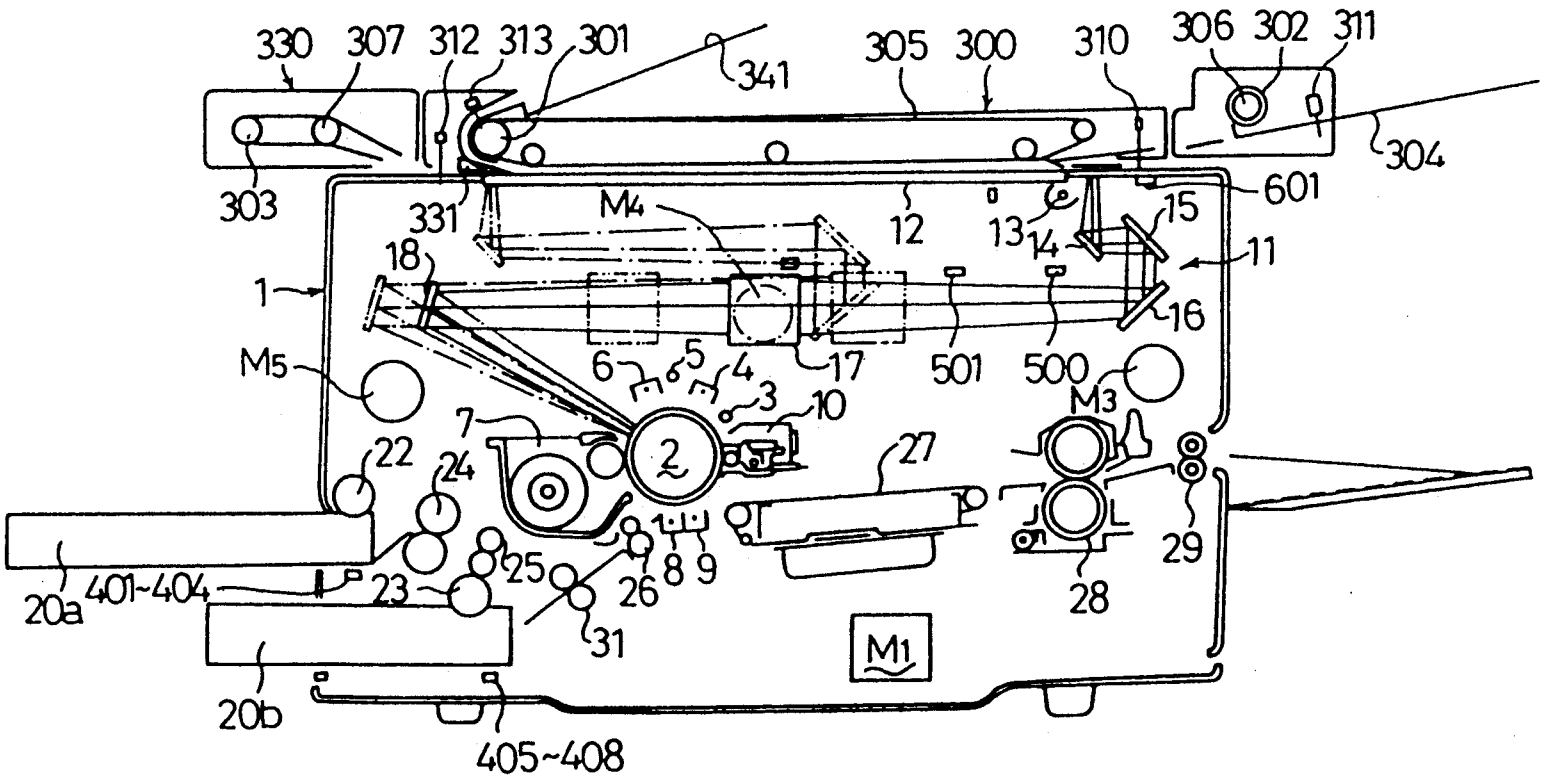
FIG. 1 is a schematic structural view showing a copying machine to which the present invention is applied as an embodiment.

FIG. 1 shows an electrophotographic copying machine to which the present invention is applied.

The main body 1 of the machine is provided with the same copying mechanism as that of a conventional copying machine. In the center of the main body 1, there is provided a photoconductive drum 2 which is driven counterclockwise. Around the photoconductive drum 2, there are subsequently provided in the driving direction of the photoconductive drum 2 a main eraser lamp 3, a subcharger 4, a suberaser lamp 5, a main charger 6, a developing device 7, a transfer charger 8, a separation charger 9 for separating a transfer sheet, a blade-type cleaning device 10 and other necessities.

The photoconductive drum 2 is electrified by the chargers 4 and 6 every time a copying operation is performed after residual electric charge is erased by irradiation of the eraser lamps 3 and 5. On the charged portion of the photoconductive drum 2, an original image is exposed by optical system 11 provided thereabove. The photoconductive drum 2 and other main mechanisms are driven by a main motor M1.

The optical system 11 is provided under a platen glass 12 on the upper surface of the main body 1 so that an original image can be scanned. The optical system is composed of a light source 13, a first mirror 14, a second mirror 15, a third mirror 16, a projection lens 17 and a fourth mirror 18. A mark M3 represents a scanning motor which moves the light source 13, the first, second and third mirrors 14–16 between the solid line and phantom line for scanning an original. If the circumferential speed of the photoconductive drum 2 is designated as V and a magnification as n, the light source 13 and the first mirror 14 are moved at the speed of V/n, and the second and third mirrors are moved at V/2n. The V/n is a speed for a scanning action.

An image of the original placed on the platen glass 12 is scanned by the light source 13, the first and second mirrors 14, 15 in the range positioned between the solid line and phantom line. An original image at each scanning position is subsequently projected on the surface of the photoconductive drum 2 by the projection lens 17 through the first mirror 14, second mirror 15, third mirror 16 and fourth mirror 18 thereby forming an electrostatic latent image corresponding to an original image on the charged surface of the photoconductive drum 2.

When the projection lens 17 is moved in the direction of optical axis, a projection magnification of an original image onto the photoconductive drum 2 is varied and it causes to vary copying magnification. The projection lens 16 is driven by a variable power motor M4. A motor M5 moves the fourth mirror 18 between the positions of solid line and phantom line corresponding to the variation of magnification to rectify an optical length accompanied by the variation in magnification.

On the left side of the main body 1, an automatic paper feed cassette **20*a* is mounted on the upper paper feed outlet and an automatic paper feed cassette 20*b* on the lower paper feed outlet respectively. Transfer sheets accommodated in the automatic paper feed cassette 20*a* and 20*b* are selectively fed into the main body 1 by respective paper feed rollers 22 and 23. The transfer sheet thus fed is transported to a pair of timing rollers 26 which are pressed in contact with each other passing through pair of transport rollers 24, 25, 31 and is temporarily stopped thereat. The leading end of the sheet is matched with the nip section of the timing roller 26** to prevent the sheet from being skewed.

On the photoconductive drum 2, an electrostatic latent image formed by the image exposure is developed with toner and visualized. The toner image after developing process is then transferred by the transfer charger 8 onto the transfer sheet fed into a transfer section. In the transfer process, the transfer sheet fed by the timing roller 26 closely contacts the photoconductive drum 2 in the transfer section, and the toner image on the photoconductive drum 2 is transferred onto the transfer sheet by corona discharge of the transfer charger 8.

Then, after the transfer process, the transfer sheet is separated from the photoconductive drum 2 by corona discharge of the separation charger 9 and the strength of the transfer sheet itself. The transfer sheet is then sucked onto a transport belt 27 provided with an unillustrated air suction means and is transported to the right side in FIG. 1 with the clockwise rotation of the belt 27. The toner of the image transferred on the transfer sheet is fused and fixed onto the transfer sheet when it passes through a fixing device 28. After the fixing process, the transfer sheet is discharged to the outside of the main body 1 passing through a pair of discharge rollers 29.

On each paper feed outlet, there are provided switches 401–404 and 405–408 respectively for detecting the size of a transfer sheet. The switches are microswitches which are arranged to detect the size of transfer sheets accommodated in the automatic paper feed cassettes **20*a* and 20*b***. They further detect whether the sheets are accommodated in the longitudinal direction or in the lateral direction relative to the paper feeding direction.

The size of transfer sheet applicable to copying operation, i.e. the sizes possible for setting into each paper feed outlet are, for instance, A3, A4, A5, B4, B5 in JIS Standard, and the sheets in sizes A4 and A5 may be set in both longitudinal and lateral directions relative to the paper feeding direction. The switches 401–405 and 405–408 also detect whether each of the automatic paper feed cassettes **20*a* and 20*b* is attached or detached which means that they also detect indirectly whether transfer sheet is accommodated in each paper feed outlet or not. The size and the direction of transfer sheet set in the paper feed outlets are detected by four-bit code corresponding to the combination of turning on and off of the switches 401–404 and 405–408, and are stored in the RAM of microcomputer CPU1 in the control circuit shown in FIG. 9**.

On the platen glass 12 of the main body 1, there is provided an automatic document feeder 300 (hereinafter called as ADF. A sensor 311 in the ADF 300 detects whether an original is in an original tray 304 or not. A motor 301 rotates a transport belt 305 of the ADF 300, while a motor 302 drives a paper feed roller 306 to feed an original on the original tray 304 to the ADF 300. The original is transported to a predetermined position which is set for image exposure on the platen glass 12 by the rotation of the transport belt 305. The feeding operation of the original at this stage is detected by an original feeding sensor 310.

A reversing unit 330 is connected with the rear end of the ADF 300, and the original being sent from the platen glass 12 by the rotation of the transport belt 305 of the ADF 300 may be forwarded to the reversing unit 330 by operating a changeover claw 331 or discharged onto a discharge tray 341. When an original on the platen glass 12 is discharged to the side of the reversing unit 330, it is detected by an original discharge sensor 312, while when an original is discharged onto the original discharge tray 341, it is detected by an original discharge sensor 313. A reversing roller 307 provided for the reversing unit 330 is driven by a reversing motor 303, and it can reversely transport the original forwarded to the unit 330 back to the platen glass along the circumferential surface of the roller 307. Since the transport belt 305 is reversely driven at this stage, the original may be transported to a predetermined position on the platen glass.

Figure 10:
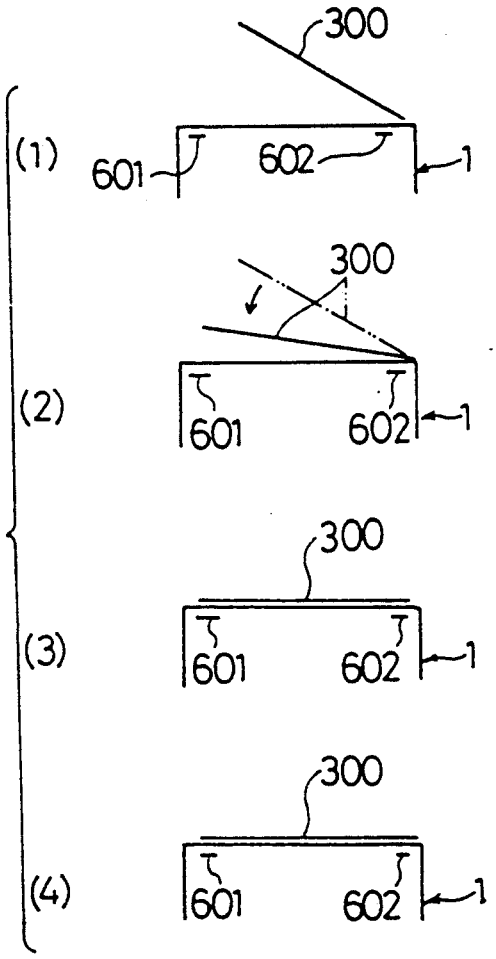
FIG. 10 is a schematic side view of a copying machine showing a flow of original size detecting actions.

As illustrated in FIGS. 1 and 10, an original cover switch 601 and an unillustrated magnet are disposed on the main body 1 and ADF 300. The original cover switch 601 comprises a reed switch and is turned on by sensing the magnet when the ADF 300 is closed so that the opening and closing actions of the ADF 300 can be detected. When the original cover switch 601 is turned on and an original is set on the original tray 304, the control of the ADF 300 is correlated with that of the main body 1 and an operation mode of the copying machine is changed over to the ADF mode.

In FIGS. 2 through 7, there are shown original size detecting mechanisms.

Figure 2:
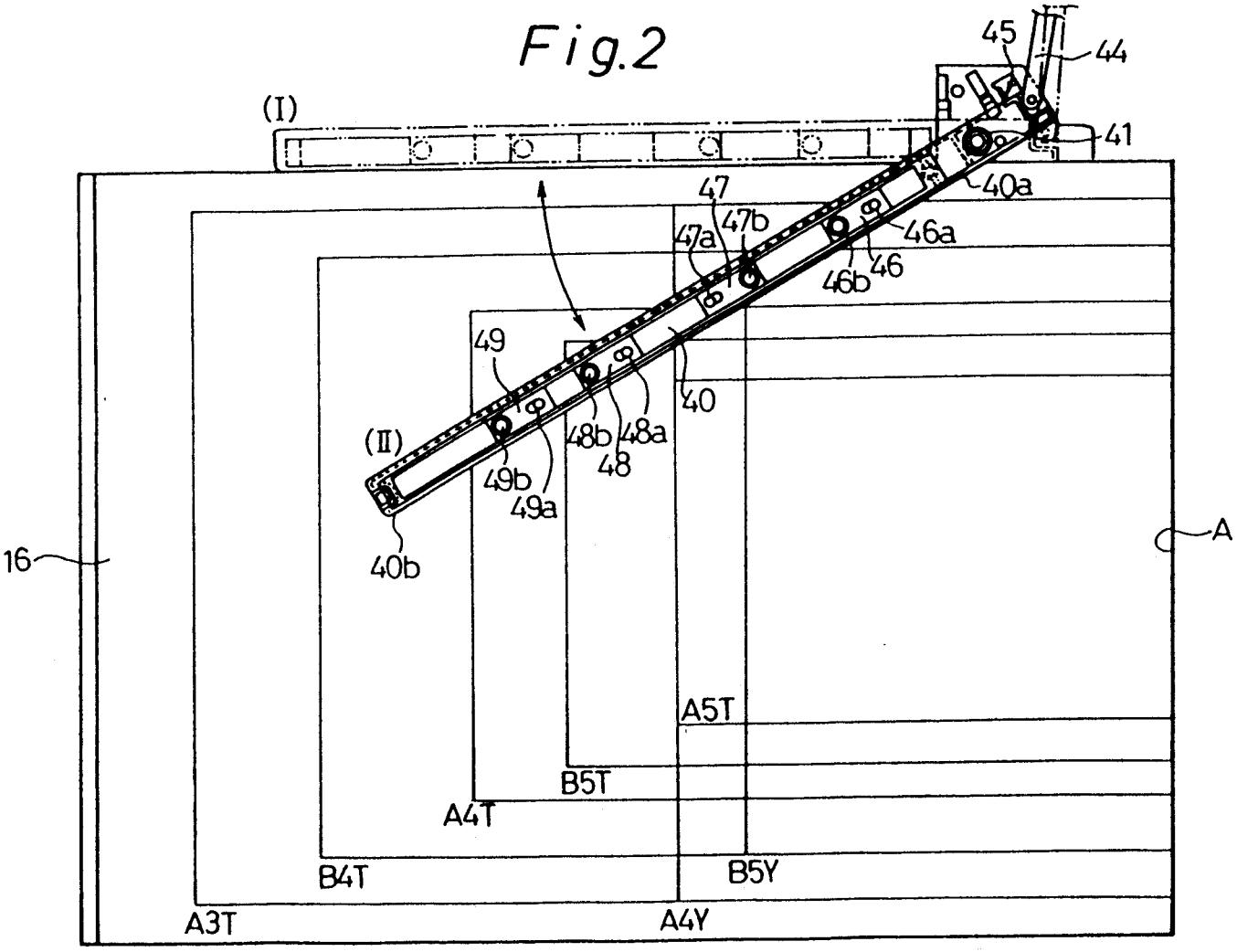
FIG. 2 is a plan view showing an original size detecting mechanism.
Figure 3:
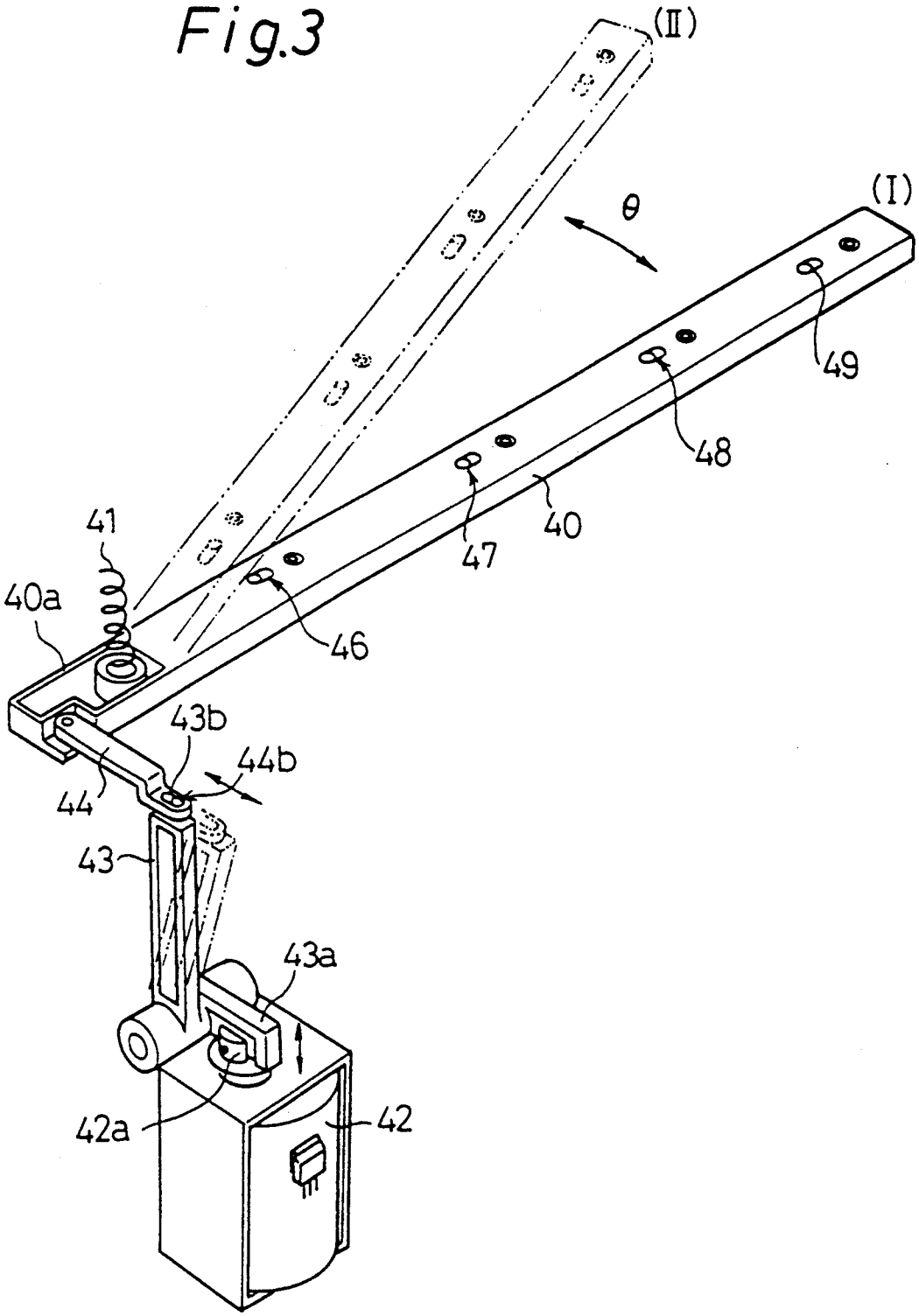
FIG. 3 is a perspective view showing an original size detecting mechanism.
Figure 4:
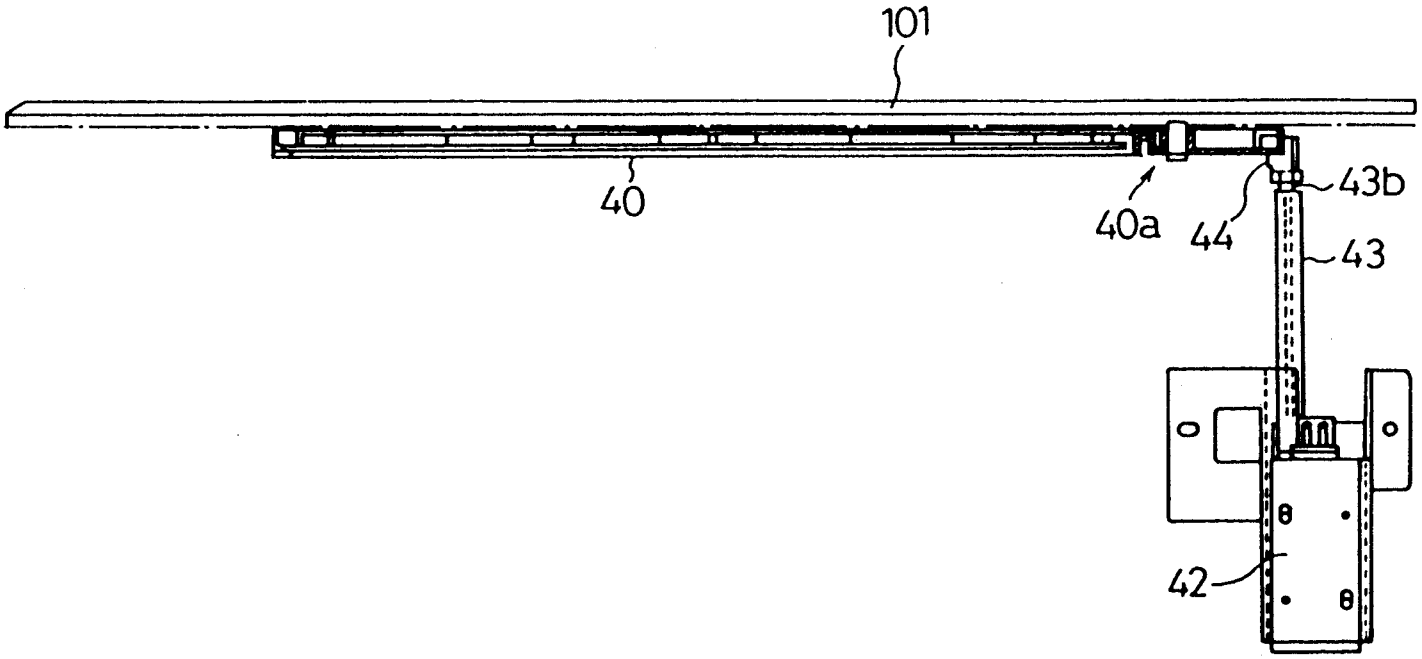
FIG. 4 is a side view showing an original size detecting mechanism.

As illustrated in FIG. 2, a long sensor support arm 40 is disposed in the optical system, the position of which is away from but nearest to the platen glass 12 on substantially the same plane of movement as that of the exposure lamp 13. The basic end side 40*a* of the sensor support arm 40 is positioned on the side of a reference end (marked by A in the figure), and the arm is pivotally supported by a frame 101 of the main body 1 through a coil spring 41 as shown in FIGS. 3 and 4. The arm is retractably provided between one side of the platen glass 12 which is a returning position (I) as shown by a phantom line and a size detecting position (II) which is a predetermined position on the platen glass 12 shown by a solid line, and is energized by the coil spring 41 so as to have returning behavior to the returning position (I).

The sensor support arm 40 is retractably driven by turning on and off a solenoid 42. The sensor support arm 40 and the solenoid 42 are connected with each other through an L-type crank lever 43 as shown in FIG. 3. The crank lever 43 is pivotally supported at its center, and one end 43*a* of the lever is connected to a movable shaft 42*a* of the solenoid 42, while the other end of a pin portion 43*b* is connected to an end 40*a* of the sensor support arm 40 through a link 44. When the power is not applied to the solenoid 42, the sensor support arm 40 is returned to the returning position (I) shown by a solid line in FIG. 3 by the restoring force of the coil spring 41. As illustrated in FIG. 2, the returning position (I) is the position where the arm is retracted from the lower position to the side position of the platen glass 12. On the other hand, the crank lever 43 is stood as shown by a solid line correlatively with the returning movement of the sensor support arm 40.

When the power is applied to the solenoid 42, it causes to rotate the crank lever 43 clockwise as shown in FIG. 3. Since the force of the solenoid 42 is stronger than that of the coil spring 41, the sensor support arm 40 is moved by the solenoid 42 to the side of the size detecting position (II) in FIGS. 2 and 3 against the coil spring 41. A stopper 45 is provided at the size detecting position (II) to stop the sensor support arm 40 being moved and accurately position and retain the leading end 40*b* of the sensor support arm 40 at a predetermined size detecting position (II) under the platen glass 12. In the present embodiment, a swinging angle $\theta$ is set at 30°.

Figure 5:
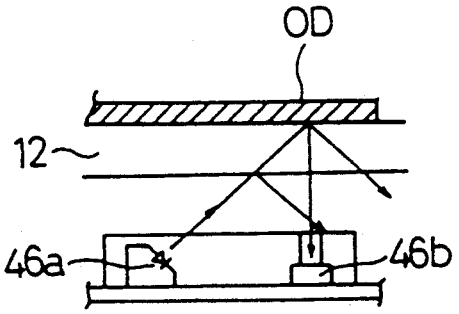
FIG. 5 is a cross-sectional view showing a part of a size detecting sensor in an original size detecting mechanism how the sensor detects an original when there is an original.
Figure 6:
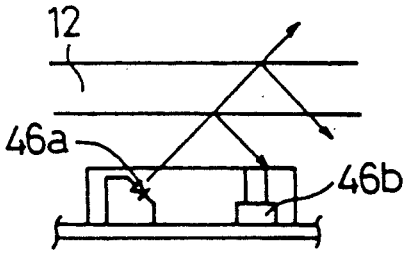
FIG. 6 is a cross-sectional view showing a part of a size detecting sensor in an original size detecting mechanism how the sensor acts when there is no original.
Figure 7:
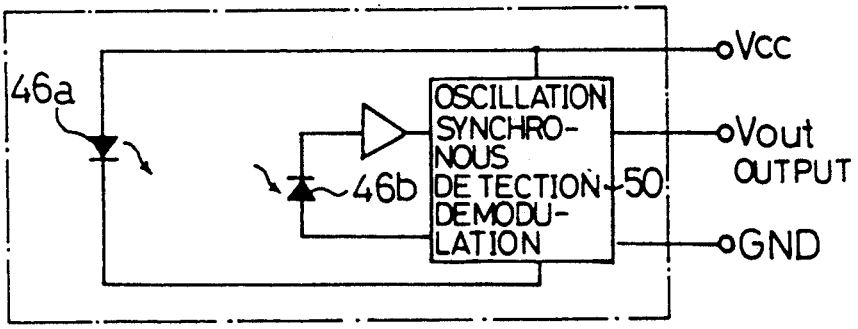
FIG. 7 is a detecting circuit diagram of a size detecting sensor.
Figure 15:
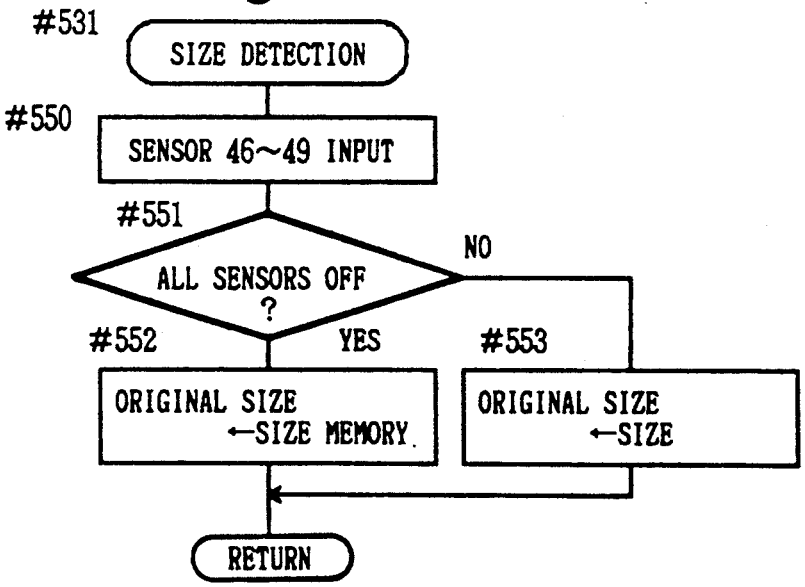
FIG. 15 is a flowchart showing a size detecting processing subroutine.

In the sensor support arm 40, four sensors 46, 47, 48, 49 are spaced apart in the longitudinal direction. As shown in FIG. 5, each sensor 46–49 comprises a light emitting element 46*a* for emitting light in the slanting direction and a light receiving element 46*b* for receiving light from the above. Accordingly, when there is no original on the platen glass 12 as shown in FIG. 6, the light emitted from the light emitting element 46*a* passes through the platen glass 12 and no light enter into the light receiving element 46*b*. On the other hand, when there is an original OD on the platen glass 12 as shown in FIG. 15, the light emitted from the light emitting element 46*a* irradiates the surface of the original positioned above the light receiving element 46*b* so that irregular reflection light enters into the light receiving element 46*b*. The light receiving element 46*b* thus becomes "Low" level by the entrance of the irregular reflection light. The light emitting element and light receiving element of each one of the sensors 46–49 are synchronized by a synchronous circuit 50 shown in FIG. 7 so as to cause the light receiving element 46*b* to receive only the light from the light emitting element 46*a*.

At a state that the sensor support arm 40 is moved to the size detecting position (II) in FIG. 2, the size of an original can be detected by detecting signals of each sensor 46–49. More particularly, referring to FIG. 2, when an original of B5 size is longitudinally placed on the platen glass 12 as shown by the mark B5T, only the sensor 48 is positioned under the original to become "Low" level (refer to 5 of Table 1). When an original of A4 size is longitudinally placed as shown by the mark A4T, the sensors 48 and 49 are positioned under the original to become "Low" level (refer to 13 of Table 1).

A sensor output when an original of A3 size is longitudinally placed is shown in 16 of Table 1, a sensor output when an original of B4 size is longitudinally placed is shown is shown in 15 of Table 1, a sensor output when an original of A4 size is laterally placed is shown in ④ of Table 1, and a sensor output when an original B5 size is laterally placed is shown in ③ of Table 1 respectively.

The sensor output patterns shown ②, ⑥– 12 and 14 of Table 1 are not the patterns used in the primary original size detecting operation. Corresponding to possible flotation of an original from the surface of the glass by bending of the original or the like, sizes of originals are specially set.

In the case where a small-sized originals are placed on the platen glass, i.e. an A5 size original in longitudinal placement (A5T), or an A5 size original in lateral placement (A5Y), B6 size original in longitudinal placement (B6T) an A6 size original in longitudinal placement (A6T) the latter of which are not shown in FIG. 2, all the sensors 46–49 are out of the positions of the originals to become "High" level so that the size of the originals can not be judged by output of the sensors. In the present embodiment, it is arranged to read a size data from the size memory which can preliminarily be set and the data is adopted as the size of originals. The sizes which can be set in the size memory are A5T, A5Y, B6T, A6T, and unknown (warning is given as unjudgeable).

TABLE 1

| | Sensor 49 | Sensor 48 | Sensor 47 | Sensor 46 | Size Detection |
|---|---|---|---|---|---|
| 1 | H | H | H | H | Size Memory |
| 2 | H | H | H | L | (A4Y) |
| 3 | H | H | L | H | B5Y |
| 4 | H | H | L | L | A4Y |
| 5 | H | L | H | H | B5T |
| 6 | H | L | H | L | (A3) |
| 7 | H | L | L | H | (B4) |

TABLE 1-continued

| | Sensor 49 | Sensor 48 | Sensor 47 | Sensor 46 | Size Detection |
|---|---|---|---|---|---|
| 8 | H | L | L | L | (A3) |
| 9 | L | H | H | H | (A4T) |
| 10 | L | H | H | L | (A3) |
| 11 | L | H | L | H | (B4) |
| 12 | L | H | L | L | (A3) |
| 13 | L | L | H | H | A4T |
| 14 | L | L | H | L | (A3) |
| 15 | L | L | L | H | B4 |
| 16 | L | L | L | L | A3 |

Figure 8:
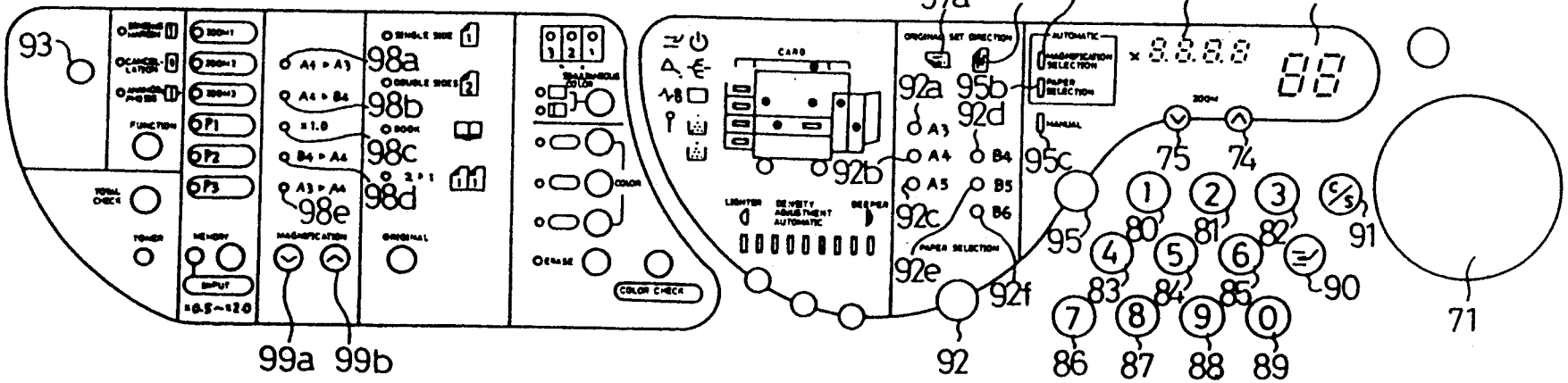
FIG. 8 is a layout drawing of an operation panel.

FIG. 8 shows an operation panel wherein the keys designated by the following reference numerals are provided. 71: print button for starting a copying operation; 80–89: ten keys for registering the number of copy sheets or the like; 90: interruption key for performing another copying operation; 91: clear/stop key (serves as a stop key for stopping multi-copying, and also for clearing the number of sheets specified); 92: paper selection key; 99*a*, 99*b*: magnification selection keys for equal magnification, two stage reduction, two stage extension; 74: magnification upgrading key for raising copying magnification at step unit; 75: magnification downgrading key for reducing copying magnification at step unit; 95: selection keys for automatic sheet selection, automatic magnification selection, manual selection; 72: two-figure indication segment for indicating the number of sheets or the like; 76: four-figure indication segment for indicating copying magnification; 92*a*–92*f*: paper size indication; 97*a*, 97*b*: indication for longitudinal and lateral placement of copy paper; 98*a*–98*e*: indication for magnification selection; 95*a*–95*c*: indications for automatic paper selection, automatic magnification selection and manual mode selection.

Figure 9:
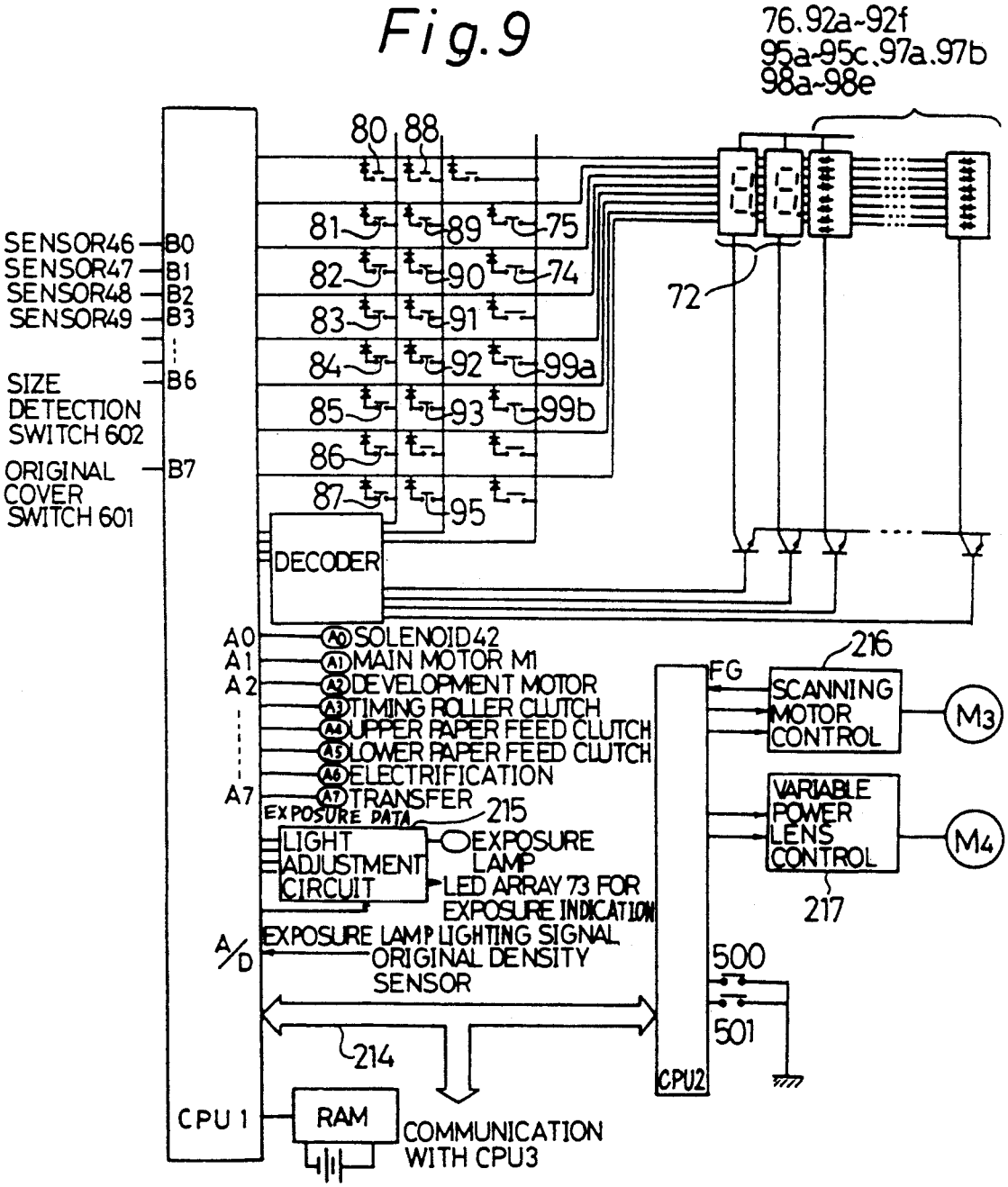
FIG. 9 is a block diagram of a control circuit.

FIG. 9 shows a control circuit of a microcomputer CPU 1 for controlling the main body 1 of the copying machine and a microcomputer CPU 2 for controlling the optical system. To the input-output terminals of the microcomputer CPU 1, various keys and indications shown in the figure are connected. To the output terminal, various parts, LED matrix (indications 72, 76, 92, 95, 97, 98) are connected, and they are controlled by the microcomputer CPU 1 through a decoder. RAM is connected to the microcomputer CPU 1 and the memory is backed up by batteries. Bus 214 is a communication line provided for connecting with other microcomputers CPU2 and CPU3. To the input terminal, there are connected sensors 46–49 for detecting the size of originals, original cover switch 601 for detecting the opening and closing of the ADF300, size detecting switch 602 (refer to FIG. 10), and a mode key 93 for setting original size detecting mode.

Input-output port of the microcomputer CPU2 is connected to a scanning motor control circuit 216 which controls the scanning motor M3 and a variable power lens control circuit 217 which controls the variable motor M4 provided for moving the projection lens 17. Signals are inputted from the switch SW500 in the optical system and the switch SW501 which transmit a timing signal for rotating the timing roller 26 when magnification is changed. The microcomputer CPU2 communicates with the microcomputer CPU1 through the bus 214.

Description will now be made on a flow of original size detecting operation in the present embodiment referring to (1) through (4) in FIG. 10.

(1) ADF300 is opened for placing an original on the platen glass 12. At this stage, both the original cover switch 601 for detecting the opening and closing of the ADF300 and the size detecting switch 602 are turned off. The size of the original is not known at this time.

(2) An original is placed on the platen glass 12 and the ADF300 is still kept open. At this stage, the original cover switch 601 is turned off, however, the size detecting switch 602 is turned on whereby signals from the sensors 46–49 are read to detect the size of the original.

(3) ADF300 is completely closed, and both the original cover switch 601 and the size detecting switch 602 are turned on. At this stage, an automatic paper selection mode (APS) or an automatic copying magnification selection mode (AMS) based on the data detected on the size of the original at (2) above are processed (more particularly, in the case of APS, search is made for paper size or paper feed outlet, in the case of AMS, magnification is calculated), and only the result is indicated.

(4) When the print key 71 is pressed, paper feed outlet or magnification is changed basing on the result of (3) above, and copying operation is started.

The above procedures may be summarized as shown in the following Table 2.

TABLE 2

| Print SW | Cover SW | Size SW | Corresponding Action |
|---|---|---|---|
| Off | Off | Off | Size Unknown |
| Off | Off | On | Size Detection |
| Off | On | On | APS/AMS Processing, Indication of Paper Feed Outlet/Magnification |
| On | On | On | Changeover of: Paper Feed Outlet/ Magnification Copy Start |

Description will now be made in detail on concrete controls referring to the flowchart shown in FIGS. 11 through 16.

It is to be noted that 'on edge' in the following description means a condition wherein keys, switches and sensors are changed from off state to on state, and 'off edge' means a condition wherein keys, switches and sensors are changed from on state to off state.

Figure 11:
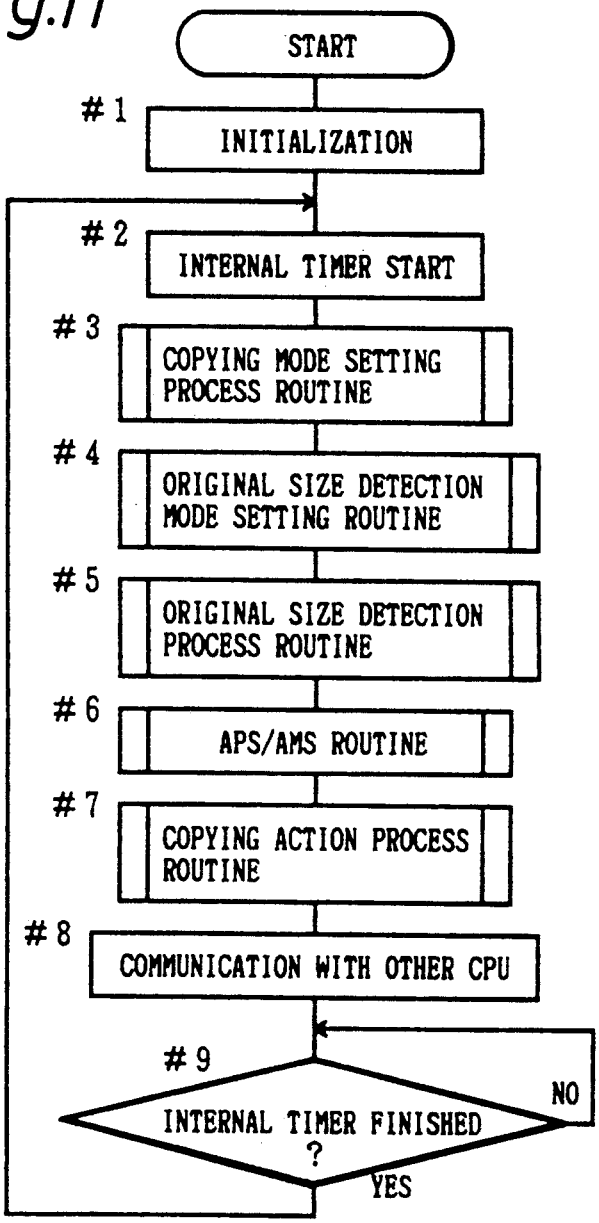
FIG. 11 is a flowchart showing a main routine of operational control of a main body.

FIG. 11 schematically shows the contents of a program of the microcomputer CPU1 which controls the main body 1.

When the microcomputer CPU1 is reset to start the program, initialization of the microcomputer CPU1 for clearing RAM, setting of various registrations, and initialization of the apparatus are performed (step #1). Then, an internal timer stored in the microcomputer CPU1 with the value set in the initialization is started (step #2). Various subroutine processing, i.e. copying mode setting processing (step #3), original size detecting mode setting processing (step #4), original detecting processing (step #5), APS/AMS processing (step #6) and copying operation processing (step #7) are subsequently performed. Data communication with the microcomputers CPU2 and CPU3 is then conducted (step #8). When all the subroutine processing are completed, the program is returned to step #2 upon completion of one routine after the internal timer initially set is finished (step 9). Utilizing the time which is used for the one routine, calculation for various timers in the subroutine is performed. Completion of each timer is judged by the number how many times one routine was repeated.

In the copying mode setting processing described at step #3 above, copying mode is subsequently changed in the order of AMS, APS, and MANUAL every time the selection key 95 provided on the operation panel is operated. Simultaneously, mode indications of 95*a* and 95*b* on the operation panel are conducted corresponding to the changed copying mode.

Figure 12:
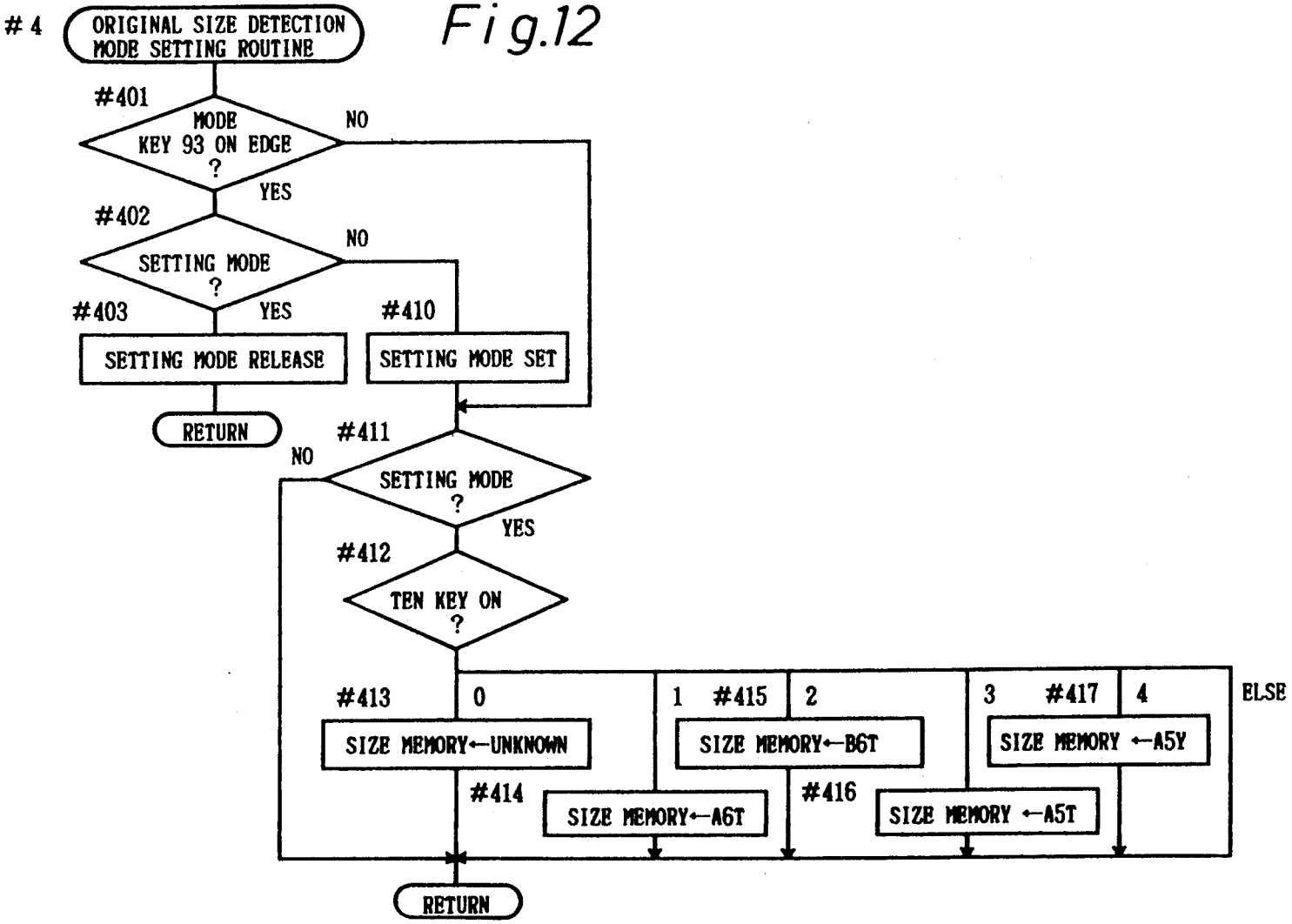
FIG. 12 is a flow chart showing an original size detecting mode processing subroutine.

FIG. 12 shows a flowchart of the original size detecting mode setting process subroutine at step #4. Output of the original size detecting sensors 46–49 are all set at "High" level to be handled as small-sized originals under A5 size. In other words, the small-sized originals are handled with the size of original set hereat.

When the mode key 93 is pressed (step #401), judgment is made whether the present mode is in the original size detecting mode which is set (step #402), and if it is in the mode which is set, the mode is released to finish the processing (step #403). If it is not in the mode which is set, the program proceeds to setting mode (#410). Then, if it is the present mode (step #411), judgment is made as to which key is to be operated among the ten keys 80–89 on the operation panel (step #412), and corresponding to the key judged, original size is stored in the size memory (step #413–417) and the processing is completed. If it is 0 key, size is unknown, 1 key for A6T, 2 key for B6T, 3 key for A5T, 4 key for A5Y, no key or keys other than the above, size memory is not changed.

Figure 13:
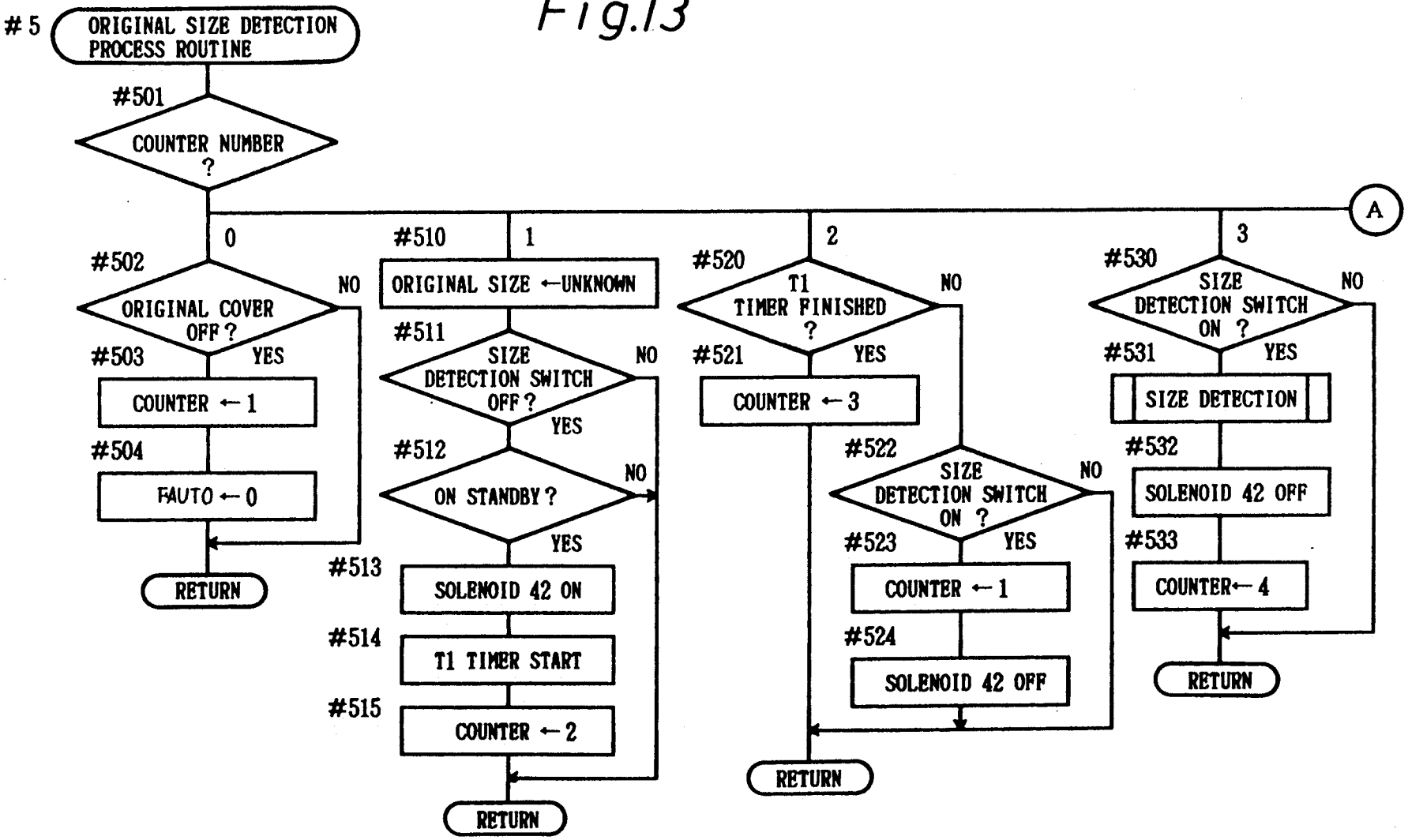
FIGS. 13 and 14 are flowcharts showing an original size detecting processing subroutine respectively.
Figure 14:
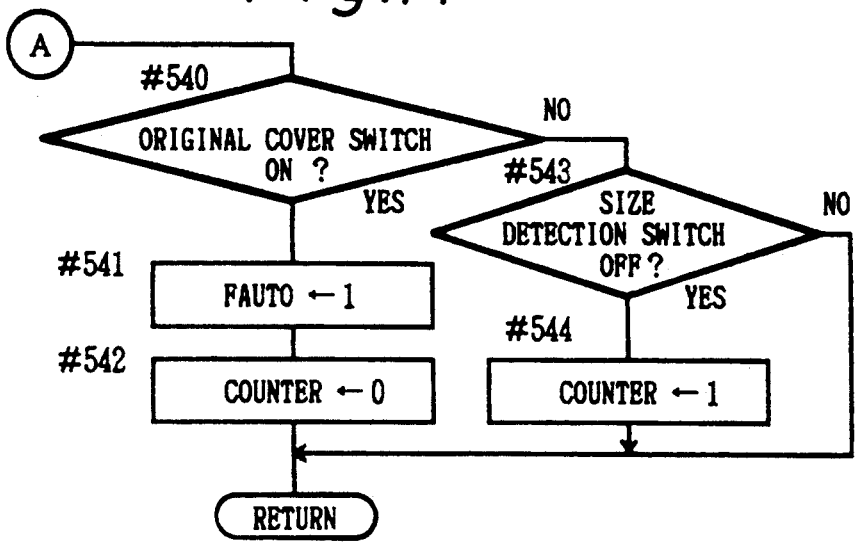

FIGS. 13 and 14 show flowcharts of the original size detecting processing routines at step #5. Counter number for controlling the state of processing in the routine is first judged, and according to the number, processing is branched as shown in the chart (step #501). Processing under the following each counter value is performed one time for one routine.

If counter is "0", judgment is made whether the original cover switch 601 is turned off or not, in other words, whether the ADF300 is opened or not (step #502), and if the ADF300 is opened, counter is set to "1" and flag FAUTO is set to "0" (steps #503, 504). The FAUTO is a flag which shows that original size detection has normally completed, and when the original cover switch 601 is turned on, counter is set to "1" which will be described later.

If counter is "1", the program proceeds to step #510 to reset the size of original, i.e. size is unknown. After the size detecting switch is turned off (step #511), if the scanning is not being performed (step #512). the solenoid 42 is turned on (step 513) to pivotally move the sensor support arm 40 to a location under the platen glass 12. At the same time, the timer T1 is started (step #514) and counter is set to "2" (step #515). With the timer T1, a time is set from the time the end portion of the sensor support arm 40 is brought in contact with the stopper 45 till the time the arm is retained at a proper position as shown in FIG. 2.

When counter became "2", counter is set to "3" (step #521) after completion of the T1 timer (step #520). The sensor support arm 40 is thus retained at a proper position. The size detecting switch 602 is kept turned on until completion of the timer T1, i.e. when the ADF300 is going to be closed (sep #522), counter is set to "1" (step #523) and solenoid 42 is turned off (step #524) to wait for the time the size detecting switch is turned off again.

At counter "3", a size is detected (step #531) after the size detecting switch is turned on (step #530), then the solenoid 42 is turned off to retract the sensor support arm 40 from below the undersurface of the platen glass, and counter is set to "4" (steps #532–#533).

At counter "4", flag FAUTO is set to "1" and counter is set to "0" (steps #541–542) after the original cover switch 601 is turned on with closing of the ADF300 (step #540). When the flag FAUTO is set, proper paper search or magnification calculation is conducted at the APS/AMS routine (step #6). On the other hand, in the case where the size detecting switch is turned off while waiting for turning on of the original cover (step #543), in other words, when the ADF300 is opened again, the counter is set to "1" (step #544), and the above process is performed again.

As described above, sensor is read at an on-edge time point when the size detecting sensors is changed from off to on state, and at the time point the original cover switch 601 is turned on, flag FAUTO is set to "1" which starts the APS/AMS processing.

FIG. 15 shows a flowchart of the size detecting process subroutine at step #531. Output signals of the sensors 46–49 are inputted first (step #550), and original size is set according to the Table 1 if all the sensors are not turned off (step #553). If all the sensors are turned off, the size data set in the size memory in the original size detecting mode setting routine (step #552) is made as original size (step #552).

Figure 16:
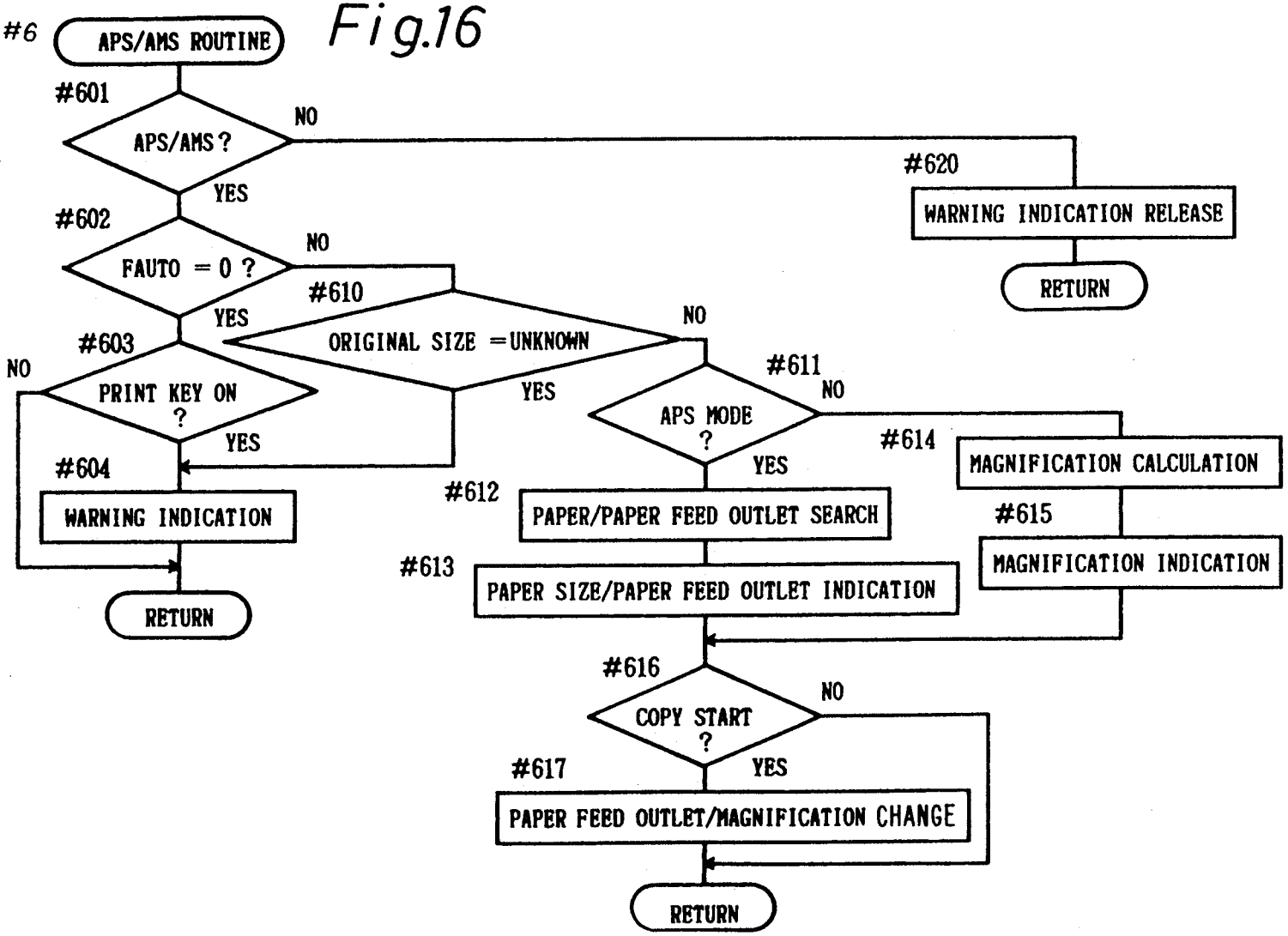
FIG. 16 is a flowchart showing an APS/AMS processing subroutine.

FIG. 16 shows a flowchart of the APS/AMS process subroutine at step #6. In the case of APS or AMS mode (step #601), judgment is made whether flag FAUTO is "0" or not (step #602). If the FAUTO is "0", the original size detecting process is not normally completed and original size is not known, and therefore, when the print key 71 is turned on (step #603), a warning is indicated (step #604). If the FAUTO=1 at step #602, judgment is made whether the original size data detected is known or unknown (step #610), and if it is unknown, a warning is indicated (step #604). If it is known and under APS mode (step #611), proper paper size and paper feed outlet are searched (step #612) and they are indicated (step #613). If it is not under APS mode (i.e. under AMS mode), magnification is calculated (step #614) and it is indicated (step #615). Thereafter, when a copying operation is started (step #616), paper feed outlet and magnification are changed to the ones indicated at steps #613 and #615. In the case of NO at step #601, the warning indication is released (step #620) to complete the processing.

The above embodiment may be summarized that the size of an original to be used for copying operation is detected in a predetermined timing before a copying operation is started. In the first timing before a copying operation is started after the detection is made, the mode which is set at this time and the size of paper and copying magnification to be automatically selected by the size information obtained by the detection are indicated at a proper time before the copying operation is started after an original is set. The operator can, therefore, make sure the indication before the start of a copying operation and the copying operation can be accomplished without having any fear that the copying is made under unanticipated mode.

In the second timing which includes the timing for starting copying operation, mode is changed to the mode indicated. Accordingly, in the case where indicated mode is not changed, copying operation can be performed earlier without interfering with a starting operation so that operational and working efficiency are not impaired.

Even when indicated mode is changed, copying operation is performed by only changing a mode to correspond with a mode to be changed in the second timing so that any inconvenience that the copy is made under unanticipated mode may be avoid.

In the case where indicated mode is not proper, an operation for changing a mode to a desired mode can be performed without unnecessary actions and consumption of time so that durability and copying efficiency are improved.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A copying apparatus, comprising:

image forming means for forming an image of an original placed on a predetermined position on a sheet of copy paper;

detecting means for detecting a size of the original to be copied in a predetermined timing before a copying operation is performed;

copying condition determining means for determining copying conditions based on the size of the original detected by the detecting means;

indication means for indicating conditions corresponding to the copying conditions determined by the copying condition determining means;

action changeover means for changing over an action of said image forming means based on the copying conditions determined by the copying condition determining means;

copy starting means for outputting a copying action start signal to said image forming means; and control means for commanding indication of the indication means in a timing corresponding to the detection by the detecting means, and also for commanding changeover of the action changeover means in a timing corresponding to the start signal of the copy starting means.

2. The copying apparatus as defined in claim 1, wherein the image forming means is capable of changing copying magnification when an original image is formed on another sheet of copy paper, the copying condition determining means being arranged to determine a copying magnification based on the size of an original detected and the size of a copy paper to be copied, and the indication means indicates a copying magnification determined by the copying condition determining means.

3. The copying apparatus as defined in claim 2, wherein the image forming means changes a copying magnification by movement of a projection lens which projects an image of an original for copying operation, and the action changeover means changes over a position of the projection lens basing on a copying magnification which is determined.

4. The copying apparatus as defined in claim 1, further comprising a paper feed means capable of feeding plural sizes of copy paper and is provided with paper feed sections for each size of copy paper, wherein the copying condition determining means determines a size of copy paper to be fed from the paper feed means based on a detected size of original, and the indication means indicates a sized of copy paper determined by the copying condition determining means.

5. The copying apparatus as defined in claim 4, wherein the action changeover means changes over a paper feed section which is actuated by the paper feed means based on the size of copy paper which has been determined.

6. The copying apparatus as defined in claim 1, further comprising a paper feed means which is capable of feeding plural sizes of copy paper and an input means for inputting a copying magnification, wherein the image forming means is capable of varying copying magnification when an original image is formed on another sheet of copy paper, the copying condition determining means being arranged to determine a size of copy paper to be fed from the paper feed means based on a copying magnification inputted by a detected size of original and the input means, and the indication means indicates a size of copy paper determined by the copying condition determining means.

7. A copying apparatus, comprising:

a platen for placing an original;

an original cover movable between a first position where the surface of the platen is covered and a second position away from the platen;

image forming means for forming an image of the original placed on the platen on a sheet of copy paper;

detecting means for detecting a size of the original on the platen with the movement of the original cover from the second position to the first position;

copying condition determining means for determining copying conditions based on a size of the original detected by the detecting means;

indication means for indicating conditions corresponding to the copying conditions;

action changeover means for changing over actions of said image forming means based on the copying conditions;

copy starting means for outputting a copying action start signal to said image forming means; and control means for commanding indication of the indication means in a timing corresponding to the detection by the detecting means, and also for commanding changeover of the action changeover means in a timing corresponding to the start signal of the copy starting means.

8. The copying apparatus as defined in claim 7, wherein the detecting means comprises a sensor which is positioned undersurface of the platen for detecting the presence of an original and an arm for supporting the sensor.

9. The copying apparatus as defined in claim 8, wherein the arm of the detecting means is positioned at a detecting position where it can detect the presence of an original when the original cover is positioned at the second position and is moved to a retracted position corresponding to the movement of the original cover to the first position.

10. A copying apparatus, comprising:

a platen for placing an original;

an original cover movable between a first position where the surface of the platen is covered and a second position away from the platen;

an image forming means for forming an image of the original placed on the platen on a sheet of copy paper;

first detecting means for detecting movement of the original cover between the first position and the second position;

second detecting means for detecting a size of the original on the platen by a detecting signal from the first detecting means which detects a movement of the original cover from the second position to the first position;

copying condition determining means for determining copying conditions based on the size of the original detected by the second detecting means;

indication means for indicating conditions corresponding to the copying conditions;

action changeover means for changing over actions of said image forming means based on the copying conditions;

copy starting means for outputting a copying action start signal to said image forming means; and control means for commanding indication of the indication means in a timing corresponding to the detection by the second detecting means, and for commanding changeover of the action changeover means in a timing corresponding to the start signal of the copy starting means.

11. The copying apparatus as defined in claim 10, wherein the first detecting means is a sensor provided on the side of the main body of the machine which is provided with the platen and detects the movement of original cover, and the second detecting means being provided with a sensor positioned undersurface of the platen for detecting the presence of an original and an arm for supporting the sensor.

12. The copying apparatus as defined in claim 11, wherein the arm of the second detecting means is positioned at a detecting position where it can detect the presence of an original when the original cover is positioned at the second position and is moved to a retracted position corresponding to the movement of the original cover to the first position.

13. A method for copying an image of an original on a sheet by projecting the original image with a lens member, including the steps of:

(a) detecting a size of the original to be copied;

(b) determining copying magnification based on the size detected in step (a);

(c) indicating the copying magnification determined in step (b);

(d) detecting a start signal to start copying operations; and (e) moving the lens member based on the copying magnification in response to the start signal detected in step (d).

* * * * *